US006655567B2

(12) United States Patent
Kim

(10) Patent No.: US 6,655,567 B2
(45) Date of Patent: Dec. 2, 2003

(54) POWER EXHAUST DEVICE FOR PACKING SHEET USED IN SHARING AND PACKING DEVICE OF MEDICINE

(75) Inventor: June Ho Kim, Daegu (KR)

(73) Assignee: JV Medi Co., Ltd., Daegu (KR)

( * ) Notice: Subject to any disclaimer, the term of this patent is extended or adjusted under 35 U.S.C. 154(b) by 11 days.

(21) Appl. No.: 09/964,351

(22) Filed: Sep. 28, 2001

(65) Prior Publication Data

US 2003/0019901 A1 Jan. 30, 2003

(30) Foreign Application Priority Data

Jul. 24, 2001 (KR) ..... 2001-0022358

(51) Int. Cl.[7] ..... B65H 20/00
(52) U.S. Cl. ..... 226/186; 226/188
(58) Field of Search ..... 226/186, 184, 226/188, 190, 191, 193

(56) References Cited

U.S. PATENT DOCUMENTS 2,181,314 A * 11/1939 Burns ..... 226/191
2,918,069 A * 12/1959 Brown, Jr. et al. ..... 226/186 X
3,830,419 A * 8/1974 Lee ..... 226/184
3,861,651 A * 1/1975 Takamura ..... 226/186 X
3,921,419 A * 11/1975 Rosenkranz et al. .... 226/184 X
4,534,499 A * 8/1985 Cox et al. ..... 226/184
5,318,430 A * 6/1994 Ramm ..... 425/141
5,722,215 A * 3/1998 Yuyama ..... 53/374.4
6,164,038 A * 12/2000 Kim ..... 53/374.4

* cited by examiner

*Primary Examiner*—Michael R. Mansen
*Assistant Examiner*—Minh-Chau Pham
(74) *Attorney, Agent, or Firm*—Jacobson Holman PLLC

(57) ABSTRACT

A power exhaust device for packing sheet used in sharing and packing device of medicine, which is mounted at the discharge position of the packing sheet containing medicine and designed to feed the packing sheet forcedly, comprises a primary motor and a secondary motor mounted abreast on a mounting plate for generating rotational force with power applied, a primary rotating body made of sponge and fixed to the shaft of the primary motor, and a secondary rotating body made of sponge and fixed to the shaft of the secondary motor, with the circumferential surfaces of both primary and secondary rotating bodies coming into contact with each other.

3 Claims, 2 Drawing Sheets

POWER EXHAUST DEVICE FOR PACKING SHEET USED IN SHARING AND PACKING DEVICE OF MEDICINE

BACKGROUND OF THE INVENTION

The present invention relates to a power exhaust device for packing sheet used in sharing and packing device of medicine, which, more particularly, is designed to continuously and forcedly feed the packing sheet containing medicine prescribed dose by dose by means of power in order to remove interference with the operation of heating rollers and a cutter.

In general, a medicine sharing and packing device denotes a machine designed to automatically dispense and pack tablets and powder prescribed dose by dose for a patient. Packing sheet is unrolled from a packing sheet roll and continuously fed. Medicine is dropped from a hopper into the folded packing sheet. The folded packing sheet containing medicine continuously comes into and is sealed by a pair of heating rollers so that medicine is packed dose by dose.

For a conventional sharing and packing device of medicine, packing sheet containing medicine prepared as prescribed is fed by feed rollers, cut by a cutter, and discharged to the outside along the discharge support plate.

However, the conventional sharing and packing device of medicine has disadvantage in that since the packing sheet containing medicine is fed and discharged by the rotation of heating rollers and feed rollers, and at this time the feed rollers work in a state of being in contact with the upper edges of the packing sheet, if the device is not handled with care a large quantity of packing sheet containing medicine may not be continuously discharged to the outside, not be spread near the heating rollers, feed rollers and cutter, and as a result, be folded near them, thereby having an adverse effect on the operation of the heating rollers and feed rollers, and particularly the cutting position may be deviated.

SUMMARY OF THE INVENTION

The present invention is contrived to overcome the conventional disadvantage described above. Therefore, it is an object of the present invention to provide a power exhaust device for packing sheet used in sharing and packing device of medicine, which is designed to continuously and forcedly feed the packing sheet containing medicine prescribed dose by dose in a straightly spread state by means of power in order to avoid interference with the operation of heating rollers and a cutter.

To achieve the above-described object, a power exhaust device for packing sheet used in sharing and packing device of medicine, which is mounted at the discharge position of the packing sheet containing medicine and designed to feed the packing sheet forcedly, comprises a primary motor and a secondary motor mounted abreast on a mounting plate for generating rotational force with power applied, a primary rotating body made of sponge and fixed to the shaft of the primary motor, and a secondary rotating body made of sponge and fixed to the shaft of the secondary motor, with the circumferential surfaces of both primary and secondary rotating bodies coming into contact with each other.

DETAILED DESCRIPTION OF THE PREFERRED EMBODIMENTS

With reference to the accompanying drawings, the present invention will now be described.

Figure 1:
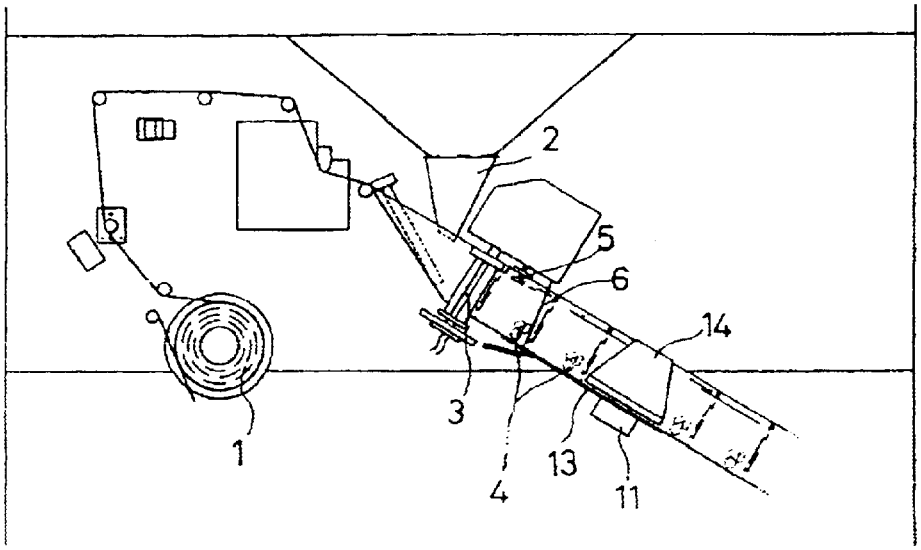
FIG. 1 is a front view showing a sharing and packing device of medicine to which a power exhaust device for packing sheet according to the present invention applies.
Figure 2:
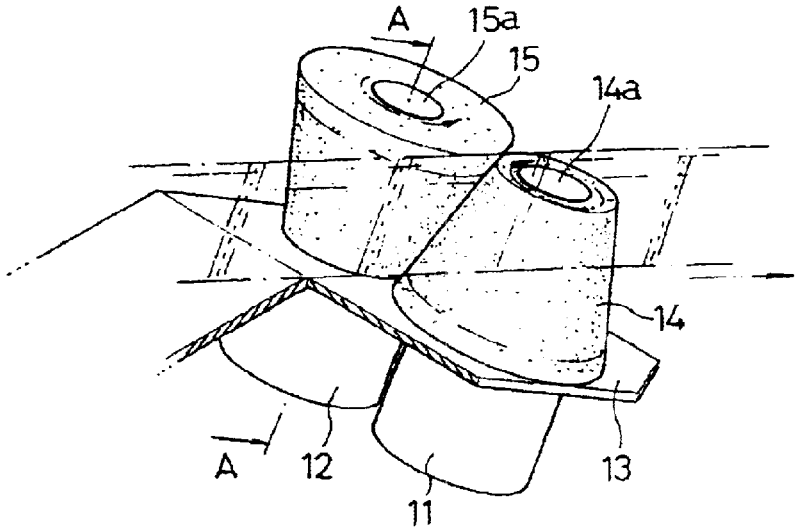
FIG. 2 is a prospective view showing a power exhaust device for packing sheet used in sharing and packing device of medicine according to the present invention.
Figure 3:
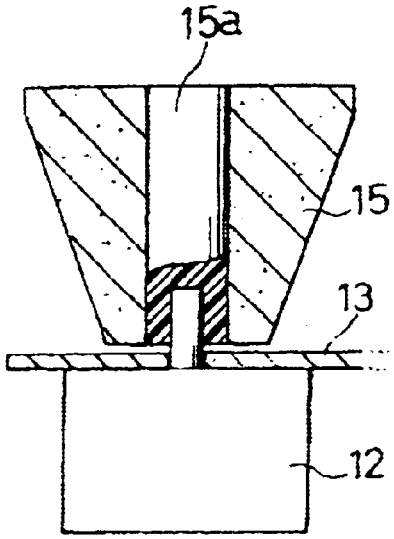
FIG. 3 is a cross-sectional view taken along line A—A of FIG. 2.

FIGS. 1, 2 and 3 show an embodiment of a power exhaust device for packing sheet used in sharing and packing device of medicine, which is mounted at the discharge position of the packing sheet containing medicine and designed to feed the packing sheet forcedly. As described above, the sharing and packing device of medicine is so constructed that packing sheet is continuously unrolled from a packing sheet roll 1, medicine is dropped from a hopper 2 into the folding portion of the packing sheet 1 which comes into between a pair of heating rollers 3 while being continuously folded in the direction of width, both edge portions of the packing sheet 1 are bonded together by the heat of the heating rollers 3 to pack medicine 4 prepared dose by dose and seal the packing sheet 1, and the packing sheet 1 containing medicine 4 is fed by feed rollers 5 and cut by a cutter 6 where necessary.

A power exhaust device for packing sheet used in sharing and packing device of medicine according to the present invention comprises a primary motor 11 and a secondary motor 12 mounted abreast on a mounting plate 13 for generating rotational force with power applied, a primary rotating body 14 made of sponge and fixed to the shaft of the primary motor 11, and a secondary rotating body 15 made of sponge and fixed to the shaft of the secondary motor 12.

To feed the packing sheet smoothly, the circumferential surfaces of both primary rotating body 14 and secondary rotating body 15 come into contact with each other, and the sponge used as a material of the rotating bodies retains elasticity to the extent that the packed medicine is not damaged when being pressed by the rotating bodies.

It is desirable to insert plastic reinforcing bodies 14*a* and 15*a* into the central portions of the primary rotating body 14 and the secondary rotating body 15 and to fix them to the shafts of the primary motor 11 and the secondary motor 12.

Further, it is desirable to form the primary rotating body 14 and the secondary rotating body 15 in a conical shape and to mount them in a direction opposite to each other on the primary motor 11 and the secondary motor 12, in order to make the area of contact surface between them larger and facilitate the feeding of the packing sheet.

A power exhaust device for packing sheet used in sharing and packing device of medicine according to the present invention works as follows.

Immediately before the end portion of packing sheet unrolled from the packing sheet roll 1 is folded and comes into the heating rollers 3, medicine is dropped from the hopper 2 into the inside of the end portion of the packing sheet 1. Immediately after medicine is dropped into the inside of the end portion of the packing sheet 1, the end portion of the packing sheet 1 is fed by the rotation of the heating rollers 3 and the feed rollers 4.

The end portion of the packing sheet 1 comes into between the primary rotating body 14 and the secondary rotating body 15 which are rotated by the rotational force of the primary motor 11 and the secondary motor 12 and is fed to the outside forcedly.

On the other hand, at the moment when medicine is dropped from the hopper 2, the heating rollers 3 and the feed rollers 4 stops temporarily. However, the end portion of the packing sheet 1 or medicine contained in the packing sheet 1 is not damaged because the primary rotating body 14 and the secondary rotating body 15 are made of sponge, and the end portion of the packing sheet 1 can be spread more easily.

Accordingly, the power exhaust device for packing sheet used in sharing and packing device of medicine according to the present invention is designed to facilitate the spreading of the packing sheet. For this embodiment, the power exhaust device for packing sheet is installed on the outlet side of a cutter 6. But in a sharing and packing device of medicine without feed rollers and a cutter it is installed on the outlet side of heating rollers.

As discussed above, the power exhaust device for packing sheet used in sharing and packing device of medicine according to the present invention is designed to feed the packing sheet containing medicine prescribed dose by dose by means of a pair of rotating bodies, made of sponge, operated by power, thereby facilitating the spreading of the packing sheet containing medicine without damage to packing sheet and medicine and removing interference with the operation of heating rollers and a cutter.

What is claimed is:

1. A power exhaust device for packing sheet used in sharing and packing device of medicine, which is mounted at the discharge position of the packing sheet containing medicine and designed to feed the packing sheet forcedly, comprising a primary motor and a secondary motor mounted abreast on a mounting plate for generating rotational force with power applied, a primary rotating body made of sponge and fixed to a primary shaft of the primary motor, and a secondary rotating body made of sponge and fixed to a secondary shaft of said secondary motor, with circumferential surfaces of said primary rotating body and secondary rotating body coming into contact with each other.

2. The power exhaust device for packing sheet used in sharing and packing device of medicine according to claim 1, wherein plastic reinforcing bodies are inserted into central portions of said primary rotating body and said secondary rotating body and fixed to the shafts of said primary motor and secondary motor.

3. The power exhaust device for packing sheet used in sharing and packing device of medicine according to claim 1, wherein said primary rotating body and secondary rotating body are formed in a conical shape, and mounted in a direction opposite to each other on said primary motor and secondary motor.

* * * * *